United States Patent [19]

Schneider, Jr. et al.

[11] 4,063,515

[45] Dec. 20, 1977

[54] DISPERSIVE SUBPROJECTILES FOR CHAFF CARTRIDGES

[75] Inventors: Clayton J. Schneider, Jr., East Aurora; Ernest V. Ruda, East Amherst, both of N.Y.

[73] Assignee: Calspan Corporation, Buffalo, N.Y.

[21] Appl. No.: 695,283

[22] Filed: June 11, 1976

[51] Int. Cl.[2] ..... F42B 13/56

[52] U.S. Cl. ..... 102/89 CD; 343/18 E

[58] Field of Search ..... 343/18 B, 18 E; 102/7.2, 34.4, 35 L, 37 L, 87, 89, 89 CD, 90, 38

[56] References Cited

U.S. PATENT DOCUMENTS

| | | | |
|---|---|---|---|
| 694,674 | 3/1902 | Scott | 102/38 |
| 2,872,864 | 2/1959 | Barnes | 102/38 |
| 3,049,080 | 8/1962 | Schermuly | 102/89 CD |
| 3,064,575 | 11/1962 | Schermuly | 102/89 CD |
| 3,137,231 | 6/1964 | Johnson | 102/89 CD |
| 3,674,174 | 7/1972 | Crewe | 102/89 CD |
| 3,899,975 | 8/1975 | Lawrence | 102/89 CD |
| 3,965,472 | 6/1976 | Constant | 343/18 B |

FOREIGN PATENT DOCUMENTS

| | | | |
|---|---|---|---|
| 924,690 | 5/1963 | United Kingdom | 102/37.6 |

*Primary Examiner*—Harold Tudor

*Attorney, Agent, or Firm*—David J. Zobkiw; Allen J. Jaffe

[57] ABSTRACT

A chaff cartridge is made up of a plurality of chaff interpackets contained in subprojectiles. The subprojectiles are each provided with fins and the fins of each subprojectile in a chaff cartridge provide a different drag to cause the spacing out of the subprojectiles. The fins, additionally, cause the subprojectiles to rotate and thereby radially disperse the chaff.

13 Claims, 14 Drawing Figures

DISPERSIVE SUBPROJECTILES FOR CHAFF CARTRIDGES

Currently employed pyrotechnic chaff cartridges consist of a fuze, a propellant charge and several packets containing tens of thousands of metalized fibers which are commonly called chaff. The packets are separated from each other by simple discs. When a chaff cartridge of this type is fired, the packets are driven out en masse and no particular control is exercised over their spacing and trajectory. The result is that the fibers are largely clumped together and do not separate. Currently, lateral chaff dispersion patterns are on the order of 10 feet in diameter with the chaff being very densely compacted laterally and elongated longitudinally to several tens of feet. In addition, conventional chaff cartridge techniques are quite likely to deform and/or fracture chaff dipoles during release. Maximum efficiency, however, is obtained when the chaff fibers are separated from each other by about the length of a fiber.

It is an object of this invention to provide for control of the chaff interpacket spacing and to simultaneously provide lateral dispersal of the chaff fibers with respect to the packet trajectory.

It is a further object of this invention to increase the average space between dispensed chaff fibers.

It is an additional object of this invention to increase the efficiencies of chaff cartridges. These objects, and others as will become apparent hereinafter, are accomplished by the present invention.

Basically the present invention provides a chaff cartridge made up of a plurality of subprojectiles each consisting of a thin cup-like container with fins in the back. The fins act: (1) to provide a different drag to each subprojectile to achieve longitudinal dispersion of the chaff; and (2) to provide a spin to each projectile by converting the forward kinetic energy to rotational energy to produce centrifugal forces and thereby radial or lateral dispersion of the chaff.

Upon firing the cartridge, the subprojectiles are propelled outward. As its fins deploy, each subprojectile casing rotates and decelerates with respect to its chaff payload. The chaff's inertia plus the tapered inner surface of the subprojectile tends to transport it laterally and beyond the subprojectile casing. Due to the transmittal of force between the chaff and the casing, some of the chaff's translational energy is converted to rotational energy. The amount of lateral and longitudinal dispersion of each chaff bundle is dependent upon the magnitudes of the angular and translational velocities of each chaff element as it is released from the casing. By designing inverse rotations between alternate subprojectile casings, the casings themselves will disperse laterally as they are releasing the chaff, thereby increasing the total lateral chaff dispersion between successive subprojectiles. Total longitudinal dispersion may be controlled by varying the relative fin sizes and fin shapes between successive subprojectiles and propellant burning rates and mass.

BRIEF DESCRIPTION OF THE DRAWINGS

For a fuller understanding of the present invention, reference should now be had to the following detailed description thereof taken in conjunction with the accompanying drawings wherein.

DESCRIPTION OF THE PREFERRED EMBODIMENTS

Figure 1:
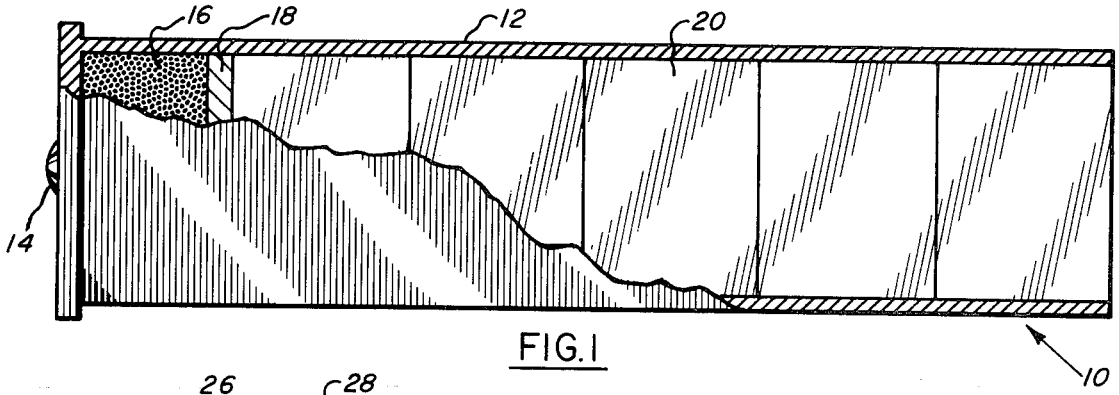
FIG. 1 is a sectional view of a high dispersion subprojectile cartridge.
Figure 2:
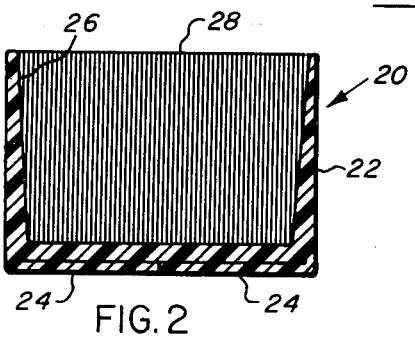
FIG. 2 is a cross-sectional view of an undeployed subprojectile.
Figure 3:
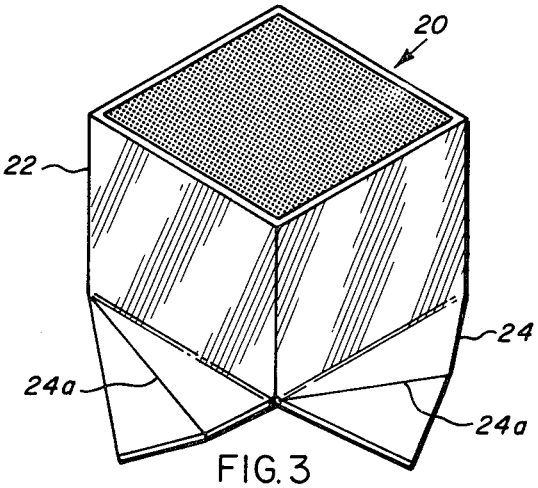
FIG. 3 is a perspective view of the subprojectile of FIG. 2 in the deployed state.
Figure 4:
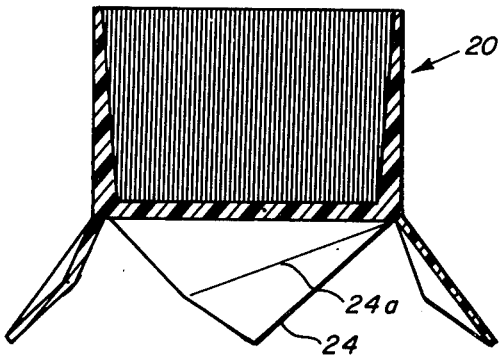
FIG. 4 is a cross-sectional view of the subprojectile of FIG. 3.

In FIG. 1 the numeral 10 generally designates a chaff cartridge. Within the casing 12 are located primer 14, propellant 16, and wadding 18 as is conventional. Additionally, the chaff cartridge 10 contains a charge made up of a plurality of subprojectiles generally designated 20. As best shown in FIG. 2, the subprojectiles 20 are generally cup-like containers 22 which are molded or machined from a resilient plastic which permits the fins 24 to be folded for storage but deploy automatically when leaving the cartridge 10. The inner wall 26 of the cup-like container 22 is outwardly tapered to aid in the dispersion of the chaff 28. Referring to FIGS. 3 and 4, the deployed fins 24 are bent along lines 24*a* and the amount and direction of the bend controls the aerodynamic drag of the subprojectile 20. In the subprojectiles 20 of FIGS. 1 – 4 the deployment of the fins and the fin angle achieved are the result of the memory of the material which returns the material to this shape when the forces associated with packing the chaff cartridge 20 are removed. Alternatively, the subprojectiles 20 may be made of light metal and springs can be used to deploy the fins or the subprojectiles may be nested together.

Figure 5:
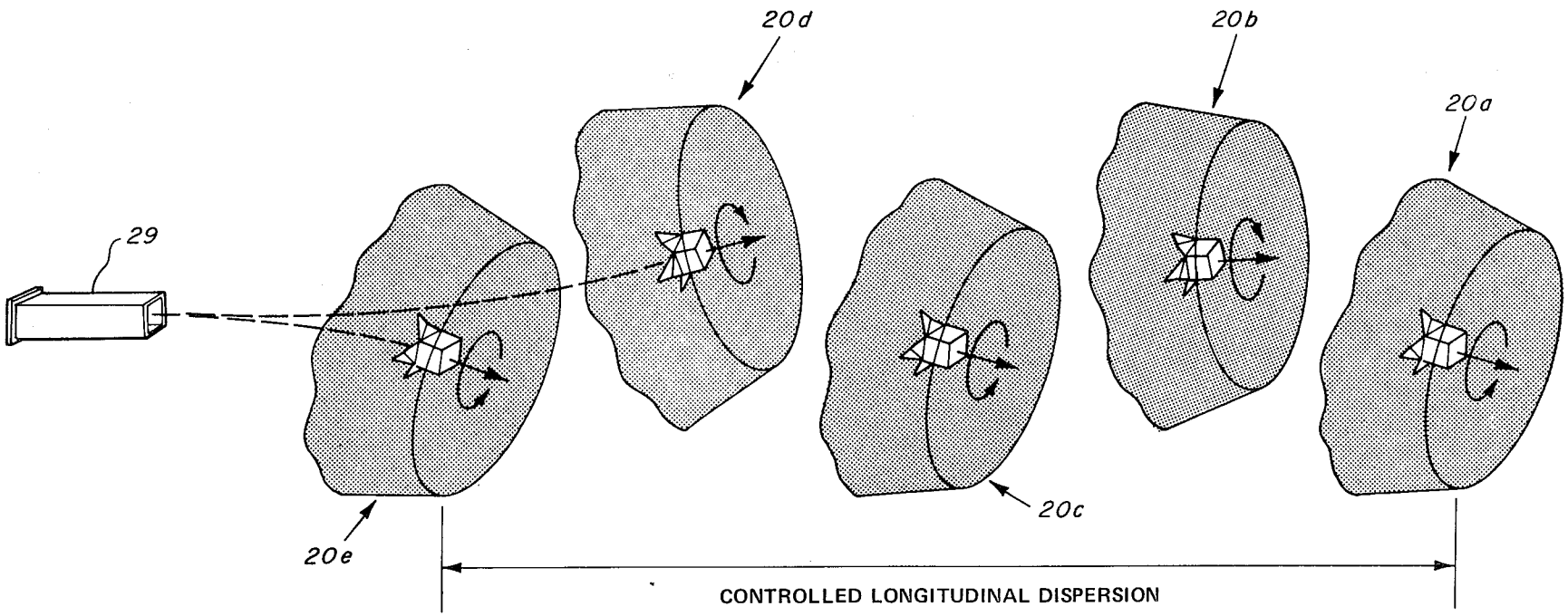
FIG. 5 is a showing of the lateral and longitudinal dispersion of the high dispersion subprojectile cartridge of FIG. 1 in a freestream release.

The lateral and longitudinal dispersion of the chaff fibers upon the firing of chaff cartridge 10 of FIG. 1 is shown in FIG. 5. The chaff cartridge 10 is fired from chaff dispenser 29. The fins 24 of each subprojectile 20 will be cut or adjusted such that the first subprojectile, designated 20*a*, to leave the cartridge 10 will have a lesser drag than the second subprojectile, designated 20*b*. Similarly, the second subprojectile, 20*b*, will have a lesser drag than the third subprojectile, designated 20*c*. This will be repeated for the rest of the subprojectiles, designated 20*d* and 20*e*, and, finally, the last subprojectile, 20*e*, to leave the cartridge 20 will have the greatest drag. Thus, by increasing the drag of each subsequent subprojectile, the spacing between them can be controlled. By spinning and spacing these subprojectiles, the total volume containing the fibers, indicated by stippling in FIG. 5, will be larger than that achieved by the previous methods and the efficiencies of the cartridges will be increased.

Figure 6:
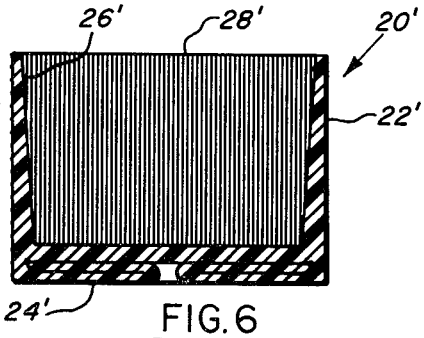
FIG. 6 is a cross-sectional view of an undeployed, modified subprojectile.
Figure 7:
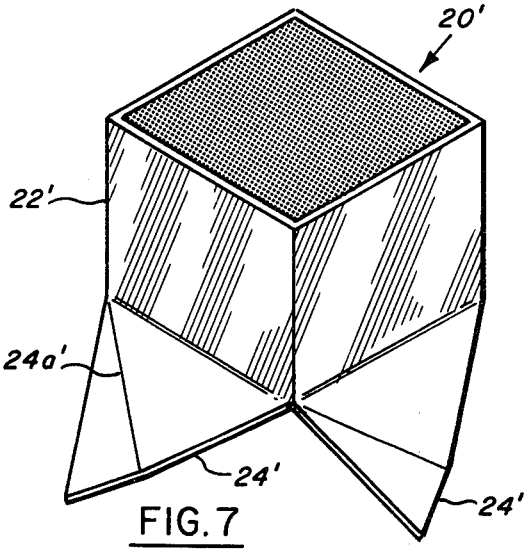
FIG. 7 is a perspective view of the subprojectile of FIG. 6 in the deployed state.
Figure 8:
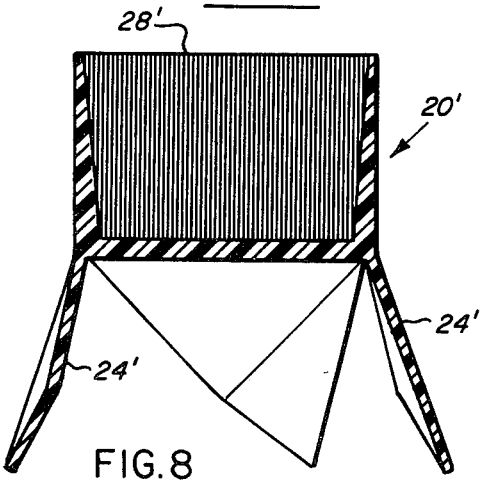
FIG. 8 is a cross-sectional view of the subprojectile of FIG. 7.

The modification of FIGS. 6 – 8 is identical to that of FIGS. 1 – 5 except that the use of longer fins requires a folding of the fins in the undeployed state. The structure of the modification of FIGS 6 – 8 has been labeled the same as in FIGS. 1 – 5 with primes added.

Figure 9:
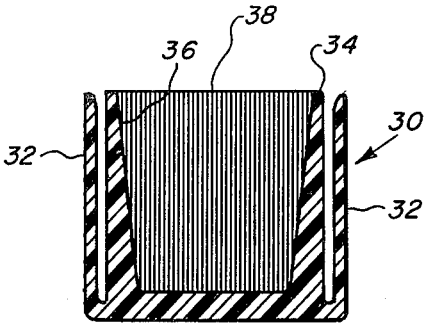
FIG. 9 is a cross-sectional view of an undeployed, second modified subprojectile.
Figure 10:
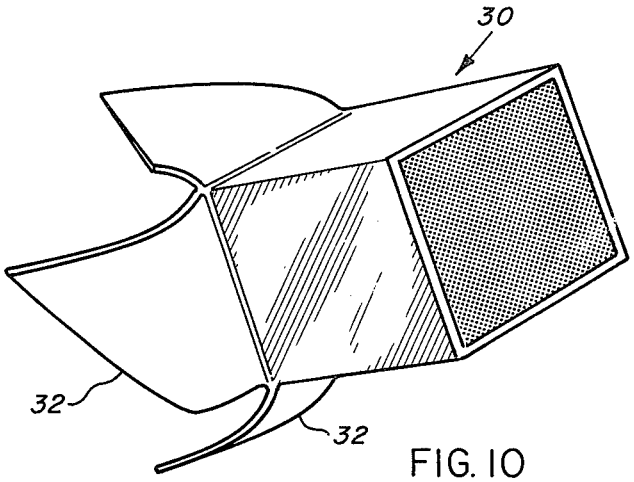
FIG. 10 is a perspective view of the subprojectile of FIG. 9 in the deployed state.

In the modification of FIGS. 9 and 10, the subprojectile is generally designated 30. The fins 32, as shown in FIG. 9, are positioned exteriorly of the cup-like portion 34 and extend in a forward direction in the undeployed state. The inner wall, 36, of the cup-like portion 34 is tapered outwardly to aid in the dispensing of the chaff 38. The deployed position of the fins 32, as shown in FIG. 10, is more quickly and positively achieved in the embodiment due to the added restoring force resulting from the extra drag initially produced as a result of fins 32 extending in a forward direction. The extra drag is eliminated when the fins 32 reach the deployed state in which they extend rearwardly.

Fin design is a tradeoff between fin storage volume in the undeployed state and the desired rate of conversion of translational to rotational velocity in the deployed state. The fins of one subprojectile may be folded underneath the subprojectile casing, as in FIGS. 1 – 8, they may be folded at the sides of the subprojectile, as in FIGS. 9 and 10, they may be superimposed or nested on the next subprojectile casing, as in the case of the subprojectiles of FIGS. 11 – 13, or they may be stacked as in the case of the subprojectiles of FIG. 14.

Figure 11:
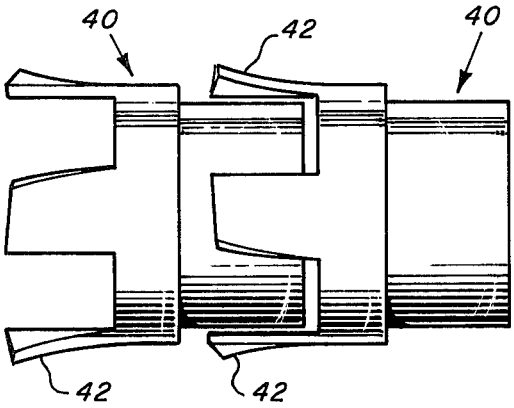
FIG. 11 is an exploded view of a third modified subprojectile.
Figure 12:
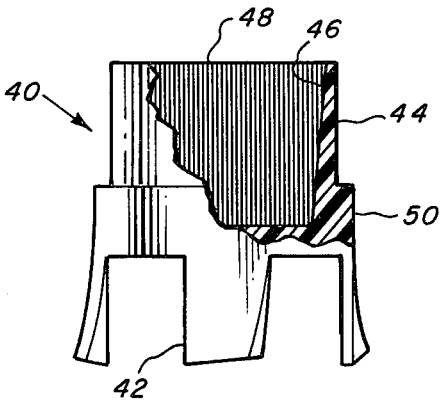
FIG. 12 is a sectional view of the subprojectile of FIG. 11.

As best shown in FIG. 11, the subprojectiles 40 are identical except for the length and angle of the fins 42 in the deployed state, as illustrated. As in the subprojectiles of FIGS. 1 – 5, the fins 42 provide a different drag to each subprojectile to achieve lateral spacing and a spin to produce a centrifugal dispensing action on the chaff fibers. Referring to FIG. 12, each subprojectile 40 includes a cup-like portion 44 having a tapered inner wall 46 and having chaff 48 located therein. Integral with the cup-like portion 44 is base portion 50 which is of a greater inner diameter than the outer diameter of the cup-like portion 44 to permit nesting therein as shown in FIG. 11. Operation of the subprojectiles 40 of FIGS. 11 and 12 will be identical to that of the subprojectiles 20 of FIGS. 1 – 5.

Figure 13:
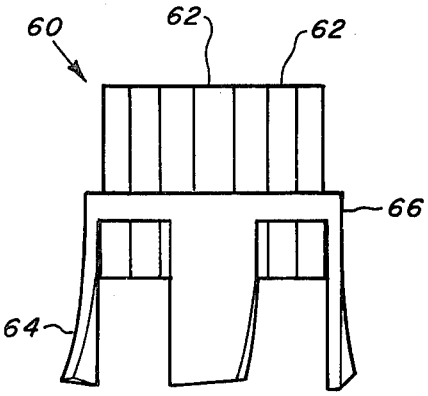
FIG. 13 is a perspective view of a fourth modified subprojectile.

Unlike the subprojectiles of FIGS. 1 – 12 and 14, the subprojectile 60 of FIG. 13 does not have a cup-like portion having a tapered inner wall. Instead, subprojectile 60 is made up of a number of segmented chaff containers, 62, having a plurality of fins, 64, which are held in place by prestressed retainer ring 66. When fired, the fins 64 cause the rotation of the subprojectile 60 and, upon the reaching of a predetermined rotation rate, the centrifugal force causes the rupture of the prestressed retainer ring 66 causing the radial dispersal of the chaff container 62 which rupture, freeing the chaff fibers.

Figure 14:
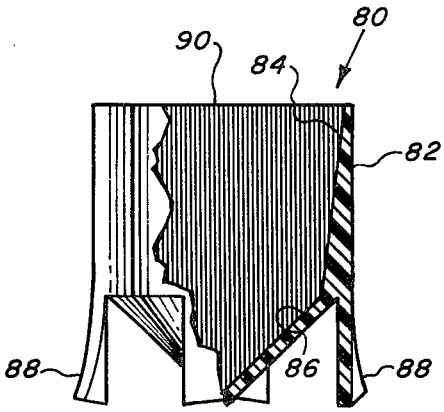
FIG. 14 is a partially sectioned view of a fifth modified subprojectile.

The subprojectile 80 of FIG. 14 has a generally conical cup-like container 82 having tapered inside walls 84 and 86 and integral fins 88. The conical taper 86 permits the chaff fiber 90 to be of varying length and therefore effective over a wider portion of the radar band. The tapered walls 84 aid in the radial dispersion of the chaff due to the centrifugal forces produced by rotation of the subprojectile 80. Although a conical surface defined by walls 86 has been illustrated, the desired distribution of chaff fiber lengths may require a curved or irregular surface.

Although preferred embodiments of the present invention have been illustrated and described, other changes will occur to those skilled in the art. For example, the cross sectional configuration can be modified by locating flat areas on the cylindrical surface of the cup-like member to permit its nesting with the fins of the adjacent subprojectile. Also, the fins may be separate members and deployed by springs. It is therefore intended that the scope of the present invention is to be limited only by the scope of the appended claims.

We claim:

1. In a chaff cartridge of the type having a casing, a primer, a fuze, a propellant charge and a plurality of chaff fibers wherein the improvement comprises a plurality of chaff subprojectiles each of which including:

means defining axially opening cup-like members for receiving said chaff fibers and having outwardly tapering inner walls for directing said chaff fibers radially outward when said subprojectiles are subjected to centrifugal forces; and drag producing means for separating said projectiles and converting forward motion to rotational motion and for causing said subprojectiles to rotate and thereby produce centrifugal forces which cause said chaff fibers to coact with said tapering inner walls and to be radially dispensed with respect to said rotating subprojectiles upon the firing of said chaff cartridge due solely to centrifugal and inertial forces.

2. The improvement of claim 1 wherein said drag producing means are fins.

3. The improvement of claim 2 wherein the fins of each subprojectile are of different length and angle to cause said subprojectiles to be spaced out longitudinally upon the firing of said chaff cartridge.

4. The improvement of claim 3 wherein the fins of each subprojectile are prestressed to deploy the fins upon the firing of said chaff cartridge.

5. The improvement of claim 3 wherein the angles of said fins are such as to produce alternating directions of rotation in said subprojectiles.

6. The improvement of claim 2 wherein said fins are adjustable in length and angle.

7. The improvement of claim 1 wherein said drag producing means for causing said subprojectiles to rotate are fins which extend forwardly in the undeployed state and rearwardly in the deployed state.

8. The improvement of claim 1 wherein said tapering inner walls of said cup-like members are joined by a surface having a varying topography which determines the length distribution of said chaff fibers in each of said subprojectiles.

9. A subprojectile for use in a chaff cartridge including: chaff fibers;

means defining an axially opening cup-like member for receiving said chaff fibers and having outwardly tapering inner walls for directing said chaff fibers radially outward when said subprojectile is subjected to centrifugal forces; and drag producing means for converting forward motion to rotational motion and causing said subprojectile to rotate and thereby produce centrifugal forces which cause said chaff fibers to coact with said tapering inner walls and to be radially dispensed with respect to said projectile when said projectile is rotating.

10. The subprojectile of claim 9 wherein said drag producing means are a plurality of fins attached to said means defining an axially opening cup-like member for receiving chaff fibers.

11. The subprojectile of claim 10 wherein said plurality of fins are adjustable in length and angle.

12. The subprojectile of claim 9 wherein said drag producing means for causing said subprojectile to rotate are fins which extend forwardly in the undeployed state and rearwardly in the deployed state.

13. The subprojectile of claim 9 wherein said tapering inner walls of said cup-like member are joined by a surface having a varying topography which determings the length distribution of said chaff fibers in said subprojectile.

* * * * *